US008152473B2

(12) United States Patent
Clemen

(10) Patent No.: US 8,152,473 B2
(45) Date of Patent: Apr. 10, 2012

(54) AIRFOIL DESIGN FOR ROTOR AND STATOR BLADES OF A TURBOMACHINE

(75) Inventor: Carsten Clemen, Mittenwalde (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1175 days.

(21) Appl. No.: 11/984,826

(22) Filed: Nov. 21, 2007

(65) Prior Publication Data

US 2009/0226322 A1 Sep. 10, 2009

(30) Foreign Application Priority Data

Nov. 23, 2006 (DE) ..... 10 2006 055 869

(51) Int. Cl.
*F01D 5/20* (2006.01)

(52) U.S. Cl. ..... 416/241 R; 416/DIG. 2; 416/DIG. 5

(58) Field of Classification Search ..... 416/241 R, 416/DIG. 2, DIG. 5
See application file for complete search history.

(56) References Cited

U.S. PATENT DOCUMENTS

| | | | | |
|---|---|---|---|---|
| 4,431,376 | A | 2/1984 | Lubenstein | |
| 4,652,212 | A | 3/1987 | Burger | |
| 4,795,312 | A | 1/1989 | Purcaru | |
| 5,312,230 | A | 5/1994 | Oda | |
| 7,416,382 | B2 * | 8/2008 | Guemmer | 415/160 |
| 7,419,353 | B2 * | 9/2008 | Guemmer | 415/191 |
| 2002/0065636 | A1 | 5/2002 | Yamaguchi et al. | |
| 2004/0091353 | A1 | 5/2004 | Shahpar et al. | |
| 2006/0165520 | A1 | 7/2006 | Guemmer | |
| 2006/0210395 | A1 | 9/2006 | Schuster et al. | |
| 2007/0140837 | A1 * | 6/2007 | Guemmer | 415/160 |

FOREIGN PATENT DOCUMENTS

| | | | |
|---|---|---|---|
| CA | 2324950 | A1 | 9/1999 |
| DE | 32 01 436 | C1 | 4/1983 |
| DE | 34 41 115 | C1 | 1/1986 |
| DE | 31 41 948 | C2 | 11/1990 |
| DE | 692 03 058 | T2 | 10/1995 |
| DE | 42 43 052 | B4 | 10/2004 |
| DE | 698 20 853 | T2 | 11/2004 |
| DE | 601 12 551 | T2 | 6/2006 |
| DE | 10 2005 060 699 | A1 | 6/2007 |
| EP | 0 533 319 | B1 | 6/1995 |
| EP | 0661413 | | 7/1995 |
| EP | 1186747 | | 3/2002 |
| EP | 1 259 711 | B1 | 8/2005 |
| EP | 1657401 | | 5/2006 |
| WO | WO 2007/042 522 | A1 | 4/2007 |

OTHER PUBLICATIONS

European Search Report dated Apr. 21, 2009 from counterpart European patent application No. 07120051.3.

* cited by examiner

*Primary Examiner* — Edward Look
*Assistant Examiner* — Aaron R Eastman
(74) *Attorney, Agent, or Firm* — Timothy J. Kilma; Shuttleworth & Ingersoll, PLC

(57) ABSTRACT

For the rotor and stator blades of turbomachines, more particularly of gas-turbine engines, an airfoil design is provided with a defined area of a skeleton line angle distribution for skeleton lines of airfoil sections near the gap. With the distribution of the dimensionless skeleton line angles ($\alpha$) over the chord length (l) in a certain area between two limiting curves (7, 8) according to the present invention, and the corresponding course of the skeleton lines in a blade portion extending up to 30 percent of the blade height, a uniformed pressure distribution is ensured, minimizing disturbances and losses due to the influence of the gap.

8 Claims, 6 Drawing Sheets

Figure 1:
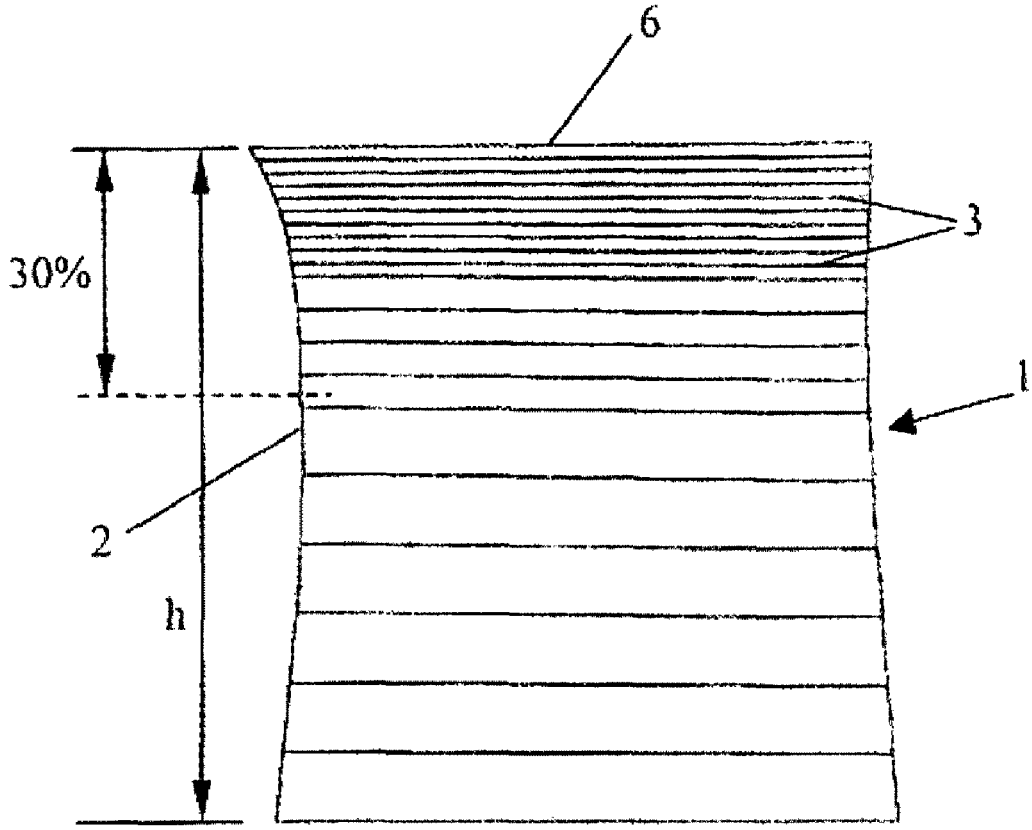

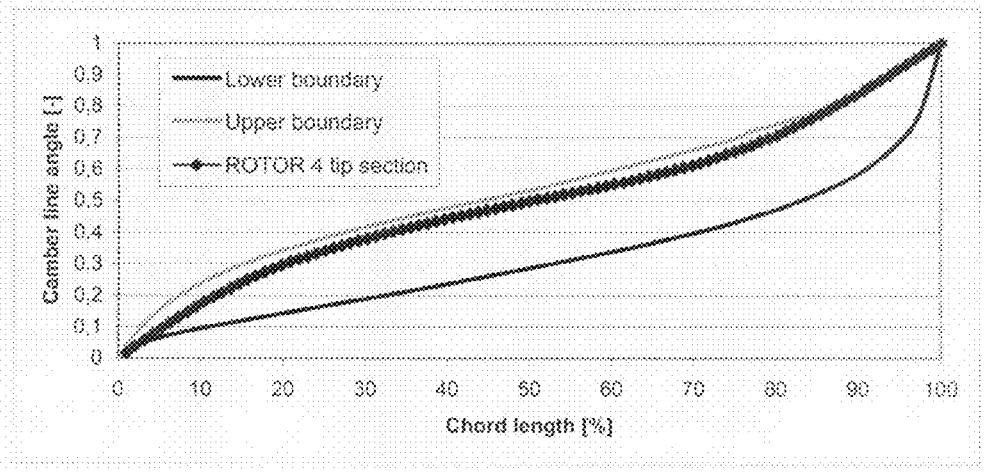
Fig. 5: Non-dimensional camber-line angle vs chord length at rotor tip
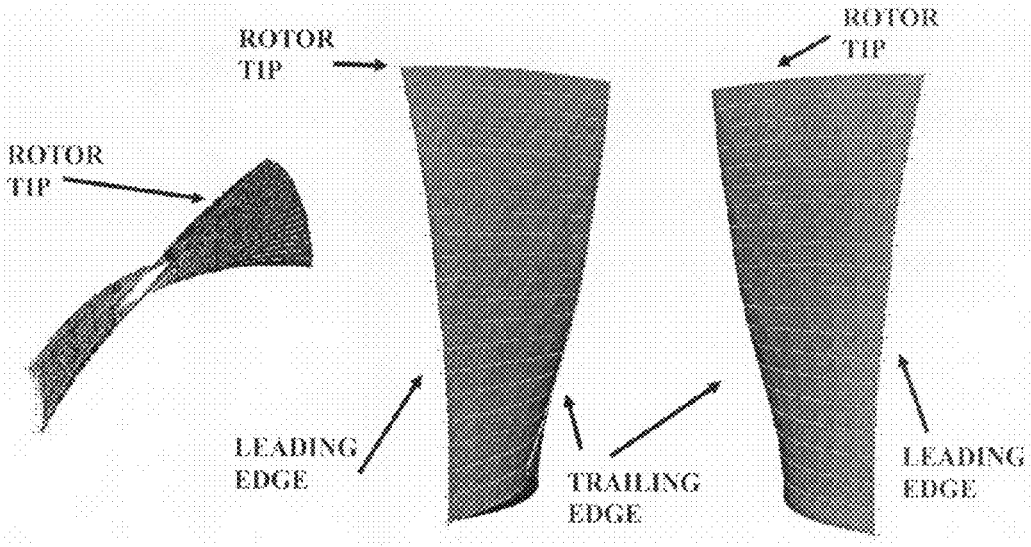
Fig. 6: Rotor geometry

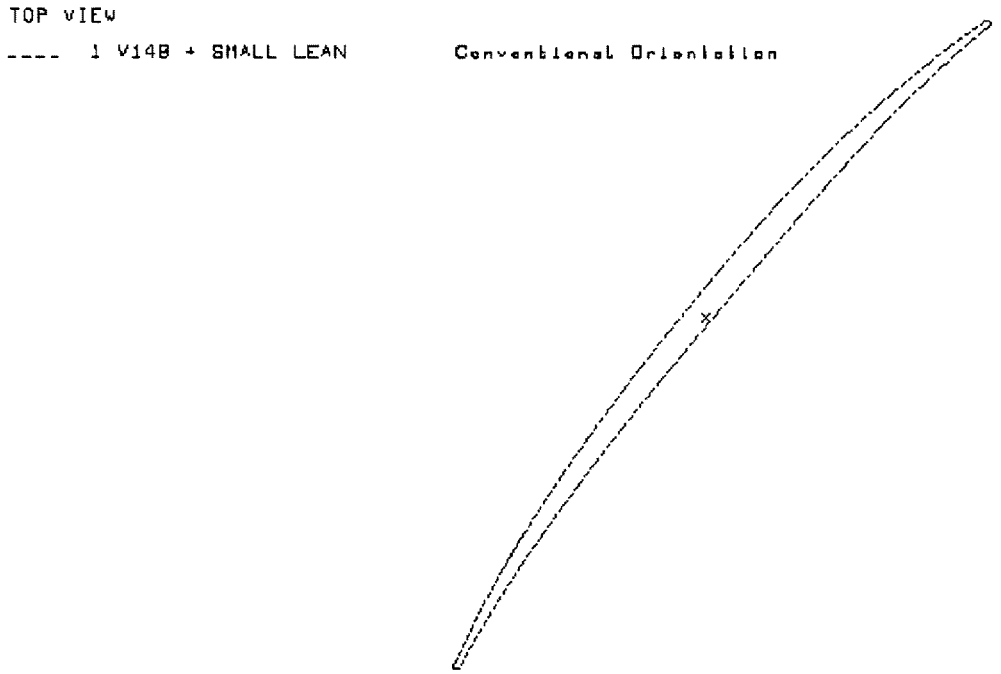
Fig. 7: Rotor tip profile
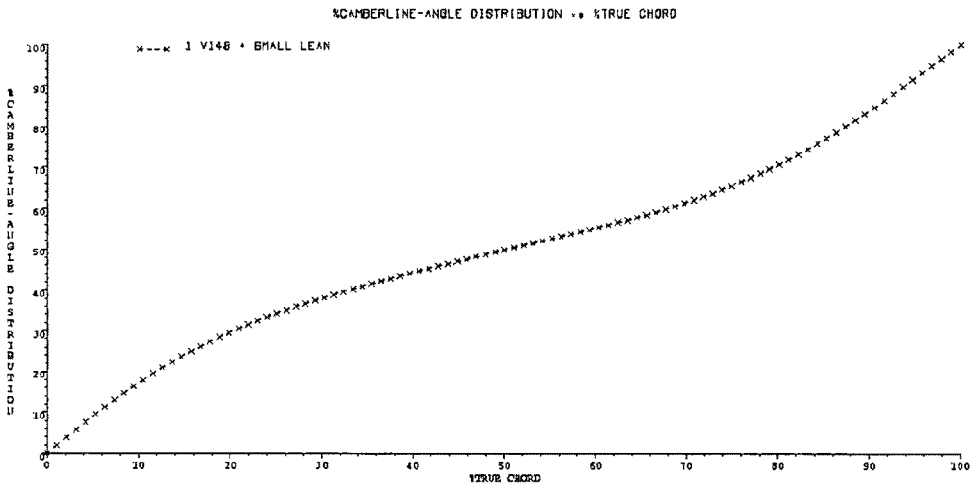
Fig. 8: Rotor tip camber-line angle distribution

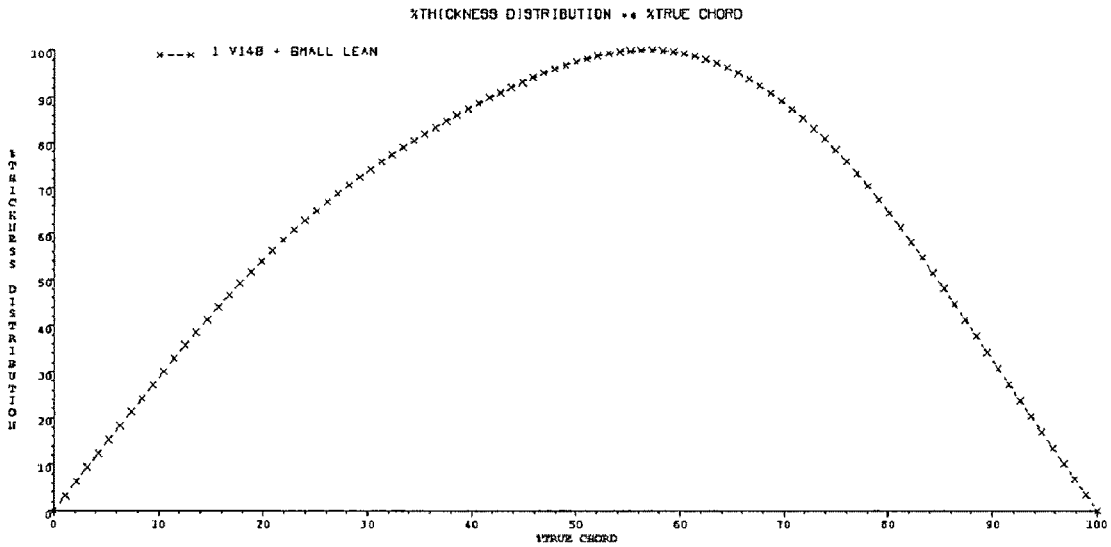
Fig. 9: Rotor tip thickness distribution

AIRFOIL DESIGN FOR ROTOR AND STATOR BLADES OF A TURBOMACHINE

This application claims priority to German Patent Application DE 10 2006 055 869.3 filed Nov. 23, 2006, the entirety of which is incorporated by reference herein.

This invention relates to an airfoil design for rotor and stator blades of a turbomachine, more particularly of a gas-turbine engine, which is defined by a course of a skeleton line established by a skeleton line angle over a chord length, an airfoil height and a course of a leading edge as well as a blade tip ending at an air gap.

The airfoil of engine blades is, under the aspect of an aerodynamically optimum shape, composed by a stack of a plurality of individual profiles over the blade height creating a three-dimensional form, with the individual profile sections having a specific skeleton line and a specific material thickness on both sides of the skeleton line. The course of the skeleton line, which is a centerline in the respective profile section, is designed for minimum profile pressure loss and maximum working range in the respective blade area. However, the currently used CDA (controlled diffusion airfoil) blade profiles and their derivatives fail to meet these requirements in the area of the blade tip, i.e. in a gap-near blade area, since the currently used blade designs do not adequately take account of the aerodynamically negative influence of the gap between the blade tip and the machine casing or the hub, respectively. Flow around and over the blade tip leads to formation of swirls in this blade area which limit the stable operation of the machine, resulting in flow and performance losses which must be compensated by increasing the number of blades—with disadvantageous consequences on cost and weight.

A broad aspect of the present invention is to provide an airfoil design of rotor and stator blades of a turbomachine which minimizes the flow disturbances occurring close to the gap and leading to performance losses.

In essence, the present invention provides for blade profile sections, which in a gap-near area of up to 30 percent of the blade height starting at the blade tip have a specific course of the skeleton line defined by the skeleton line angle in relation to the chord length of the blade profile whereby a uniform pressure distribution is established along the blade section at the gap or near the gap and, thus, a stable gap swirl is obtained. Uniform distribution of load in the gap-near blade area reduces gap losses, as a result of which, performance and stability limits are increased or, with constant performance, the number of blades, and thus weight and ultimately cost, is reduced.

The dimensionless skeleton line angles for the inventively optimum course of the skeleton line, actually for blade profile sections falling within the aforementioned 30 percent range, lie in a certain skeleton line angle distribution range which is in a coordinate system established by the chord length (x axis, in percent) and the dimensionless skeleton line angle (y axis), with the upper and lower limiting curve of the skeleton line angle distribution being defined by the equations cited below.

The dimensionless skeleton line angle is established by the relation also cited.

Provided that the skeleton lines, or the respective skeleton line angles, in the gap-near blade profile sections lie within the limits established by the limiting curves, disturbances and losses caused by the gap are significantly reduced. The form of the skeleton lines according to the present invention is not limited to specific courses of leading edges of the blades.

Figure 3:
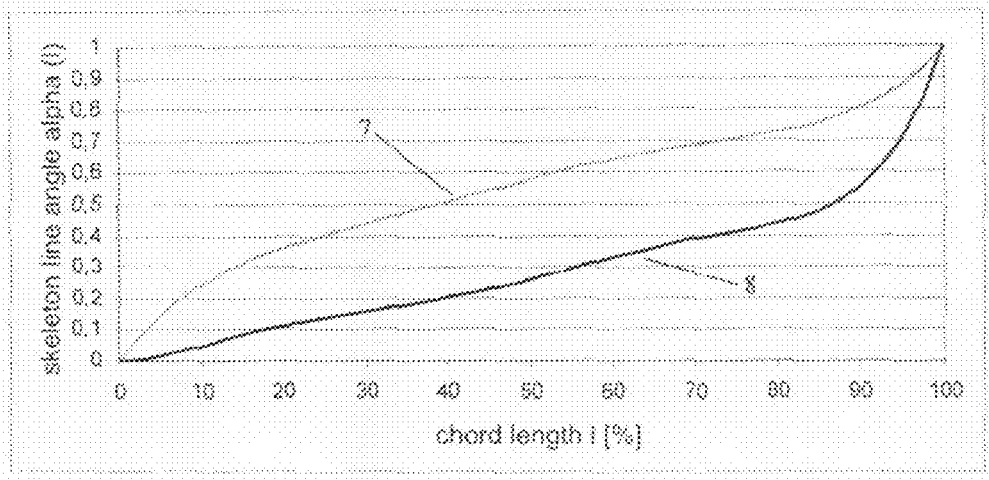
Figure 4:
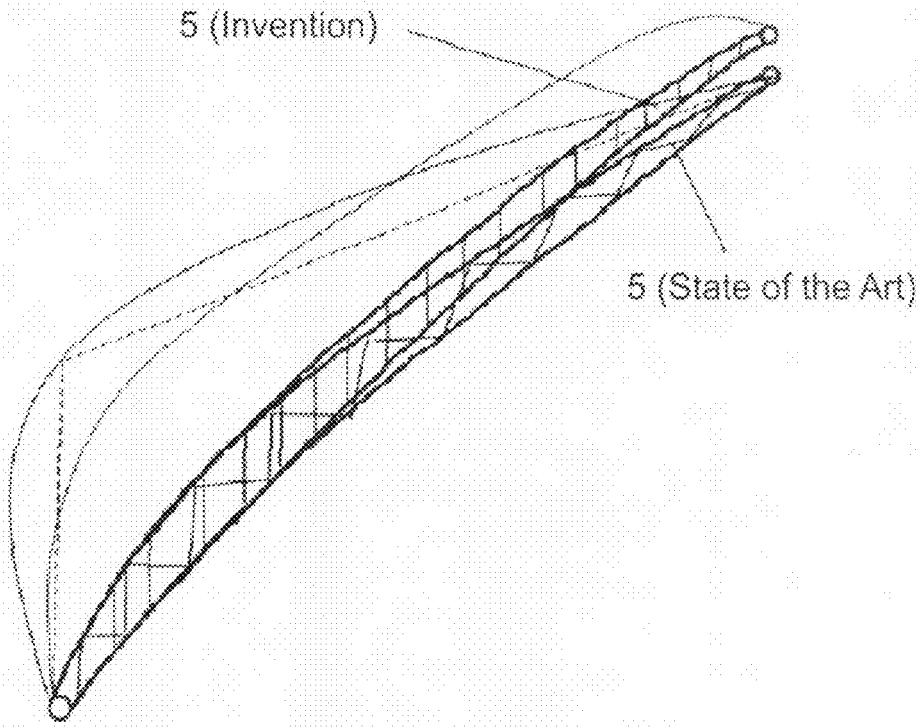

The present invention is more fully described in the light of the accompanying drawings showing a preferred embodiment. In the drawings, FIG. 1 shows a side view of a rotor blade with a swept leading edge and profile sectional planes indicated by horizontal lines, FIG. 2 is a representation of a blade profile with the skeleton line lying in a coordinate system established by the dimensionless chord length (x axis) and the dimensionless skeleton line angle (y axis), FIG. 3 shows the area of the skeleton line angle distribution limited by an upper and a lower limiting curve for a limited blade portion originating from the blade tip, FIG. 4 is a comparison between two blade profiles in the gap-near area, one designed according to the present invention, the other according to the prior art, showing the respective load distribution, FIG. 5 shows a non-dimensional camber-line angle distribution along the chord of a rotor tip section of an example rotor blade of a high-speed compressor, FIG. 6 shows a rotor geometry of the example rotor blade of FIG. 5, FIG. 7 shows a rotor tip profile of the example rotor blade of FIG. 5, FIG. 8 shows a rotor tip camber-line angle distribution of the example rotor blade of FIG. 5, and FIG. 9 shows a rotor tip thickness distribution of the example rotor blade of FIG. 5.

FIG. 1 shows a side view of an airfoil 1 of a rotor blade of a gas-turbine compressor with a swept leading edge 2. Shown here is a plurality of sectional planes 3 distributed over the blade height "h". According to the skeleton (camber) line 4 (FIG. 2) pertaining to the respective sectional plane 3 with equal material thickness "d" on either side in the respective reference point, the form of the airfoil 1 is defined by stacking the corresponding blade profile sections 5 in the sectional planes 3.

Figure 2:
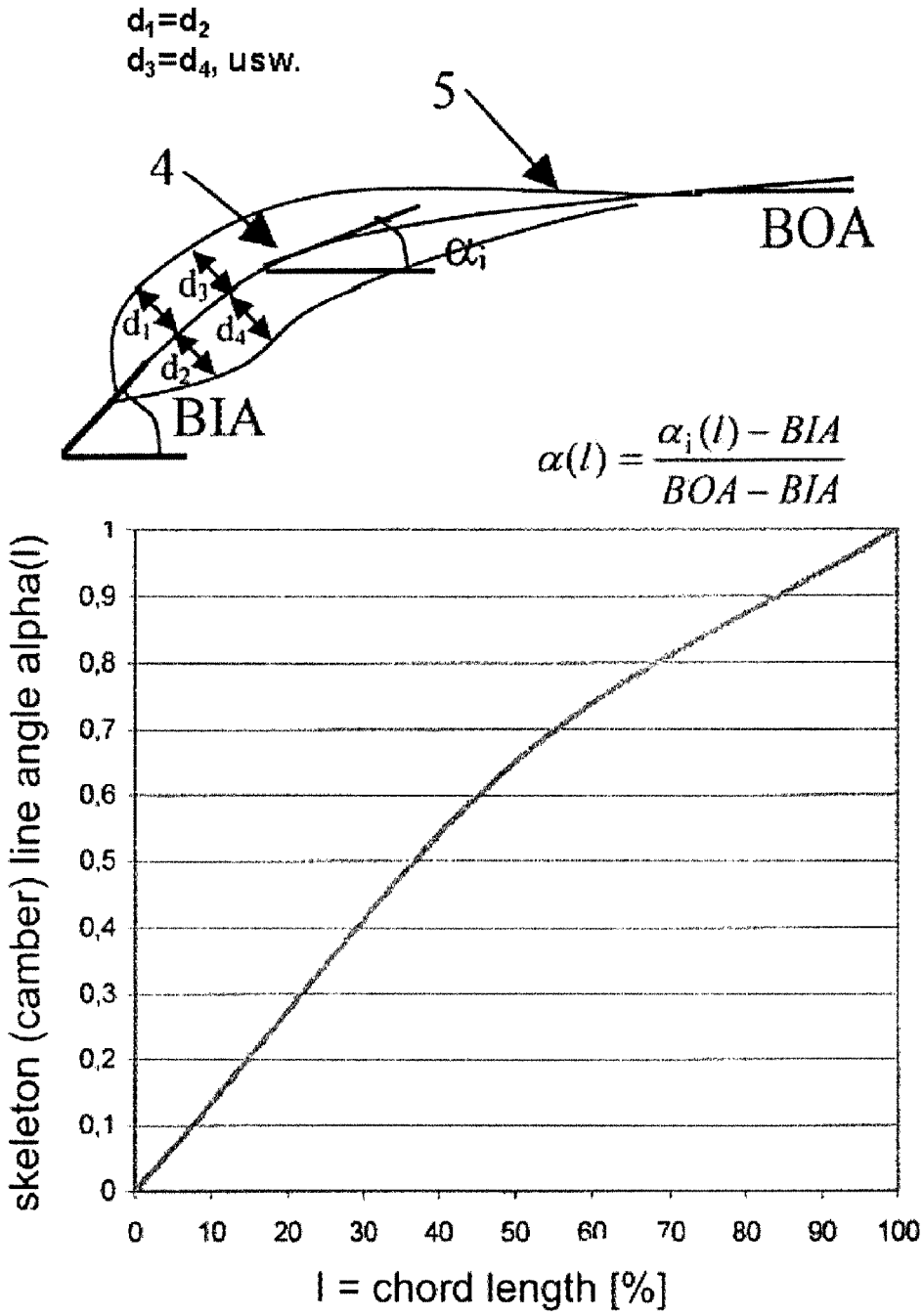

The skeleton line 4 in FIG. 2 is defined in the form of the dimensionless skeleton line angle $\alpha(l)$ along the chord length "l", which as a percentage is again dimensionless, and is established by $$\alpha(l)=(\alpha_i(l)-BIA)/(BOA-BIA),$$

where:

$\alpha_i(l)$ is the respective local angle at a certain value $l_x$ of the chord length, BIA is the inlet angle, and BOA is the outlet angle.

In an area which starts at the blade tip 6 and includes approx. 30 percent of the blade height "h" (FIG. 1) and in which the sectional planes 3 lie closer to each other, the skeleton lines 4 of the respective blade profile section 5 are such that their dimensionless skeleton line angles $\alpha(l)=0.0$ to 1.0, in all points over the dimensionless chord length l=0 to 100 percent of the respective blade profile section 5, in a predefined limiting range between an upper limiting curve 7 (oG) and a lower limiting curve 8 (uG). When the skeleton lines of the airfoil 1 in the upper, gap-near area of up to 30 percent of the blade height "h" extend in this limited skeleton line angle distribution range, an aerodynamically optimum blade profile is obtained in which, despite the gap and with three-dimensional blade form and irrespective of the course of the leading edge of the blade, the pressure load on the blade is uniformed, thereby stabilizing the gap swirls and minimizing gap losses.

The skeleton line angle $\alpha_{oG}$ for a multitude of values $l_x$ between 0 and 100 percent, i.e. $l_{x1}$, $l_{x2}$ etc of the chord length "l" is established for the upper limiting curve 7 from:

$$\alpha_{oG}=1.2893686702647\times10^{-9}\times l_x^5-3.17452341597451\times10^{-7}\times l_x^4+0.0000293283473623007\times l_x^3-0.00129356647808443\times l_x^2+0.0345950133223312\times l_x$$

and for the lower limiting curve 8 from:

$$\alpha_{uG}=3.97581923552676\times10^{-11}\times l_x^6-1.02257586096638\times10^{-8}\times l_x^5+9.81093271630595\times10^{-7}\times l_x^4-0.000042865320363461\times l_x^3+0.00082697833059342\times l_x^2-0.000113440630116202\times l_x.$$

FIG. 4 relates—with respective schematic pressure load—two blade profile sections 5 in the gap-near area, actually a blade according to the state of the art (zigzag hatching) and a blade according to the present invention (slant hatching). The pressure load indicated is essentially uniform on the blade according to the present invention and is triangular on the state-of-the art blade, the latter leading to flow disturbances and losses.

An example of a rotor blade of a high-speed compressor is shown with respect to FIGS. 5-9. FIG. 5 shows a non-dimensional camber-line angle distribution along a chord of a rotor tip section, which lies between the boundaries given by the equations discussed above. FIG. 6 shows a rotor geometry of the example blade and FIG. 7 shows a rotor tip profile. The rotor tip profile shown in FIG. 7 is generated by overlaying the camber-line angle given in FIG. 8 and the thickness distribution given in FIG. 9. The overlay is done automatically by a blade generation software program by adding the local thickness onto the local camber-line coordinate.

LIST OF REFERENCE NUMERALS

1 Airfoil
2 Leading edge
3 Sectional planes
4 Skeleton (Camber) line
5 Blade profile section
6 Blade tip
7 Upper limiting curve
8 Lower limiting curve
h Blade height
d Material thickness
$\alpha(l)$ Skeleton line angle
$\alpha_i$ Local skeleton line angle
l Chord length
$l_x$ Certain value of chord length

What is claimed is:

1. An airfoil design for rotor and stator blades of a turbomachine, which is defined by a course of a skeleton line established by a skeleton line angle ($\alpha$) over a chord length and by a course of a leading edge and a blade height as well as a blade tip ending at an air gap, wherein the skeleton line in blade profile sections which lie in an area starting at the blade tip and extending up to 30 percent of the blade height, runs in a skeleton line angle distribution range between an upper limiting curve and a lower limiting curve in which a uniformed pressure load is generated along a blade surface, with the dimensionless skeleton line angle ($\alpha$) at a respective point ($l_x$), wherein ($l_x$) is a percentage of a chord length, (l) being:

$$\alpha_{oG}=1.2893686702647\times10^{-9}\times l_x^5-3.17452341597451\times10^{-7}\times l_x^4+0.0000293283473623007\times l_x^3-0.00129356647808443\times l_x^2+0.0345950133223312\times l_x$$

for the upper limiting curve, and:

$$\alpha uG=3.97581923552676\times10^{-11}\times l_x^6-1.02257586096638\times10^{-8}\times l_x^5+9.81093271630595\times10^{-7}\times l_x^4-0.000042865320363461\times l_x^3+0.00082697833059342\times l_x^2-0.000113440630116202\times l_x$$

for the lower limiting curve.

2. The airfoil design in accordance with claim 1, wherein the dimensionless skeleton line angle ($\alpha$) is defined by the equation $(\alpha_i(l)-BIA)/(BOA-BIA)$, with $(\alpha_i(l))$ being a local angle at the respective point ($l_x$) of the chord length (l) and BIA and BOA being an inlet angle and an outlet angle of the skeleton line at a beginning and at an end of the chord, respectively.

3. The airfoil design in accordance with claim 2, wherein the skeleton lines extend within the range defined by the upper limiting curve and the lower limiting curve, irrespective of the course of the leading edge.

4. The airfoil design in accordance with claim 3, where the turbomachine is a gas turbine engine.

5. The airfoil design in accordance with claim 1, where the turbomachine is a gas turbine engine.

6. The airfoil design in accordance with claim 2, where the turbomachine is a gas turbine engine.

7. The airfoil design in accordance with claim 1, wherein the skeleton lines extend within the range defined by the upper limiting curve and the lower limiting curve, irrespective of the course of the leading edge.

8. The airfoil design in accordance with claim 7, where the turbomachine is a gas turbine engine.

* * * * *